US010518994B2

(12) United States Patent
Warner et al.

(10) Patent No.: US 10,518,994 B2
(45) Date of Patent: Dec. 31, 2019

(54) ADJUSTMENT OF FEEDER TRAYS TO CORRECT ALIGNMENT ERROR OF PRINT MEDIA IN A REGISTRATION SUBSYSTEM

(71) Applicant: Xerox Corporation, Norwalk, CT (US)

(72) Inventors: Victoria Lynn Warner, Caledonia, NY (US); Donald R. Fess, Rochester, NY (US); James L. Giacobbi, Penfield, NY (US); Matthew Ryan McLaughlin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/948,679

(22) Filed: Apr. 9, 2018

(65) Prior Publication Data

US 2019/0308832 A1 Oct. 10, 2019

(51) Int. Cl.

| | |
|---|---|
| ***B65H 7/20*** | (2006.01) |
| ***B65H 9/20*** | (2006.01) |
| ***B65H 1/26*** | (2006.01) |
| ***B41J 11/42*** | (2006.01) |

(52) U.S. Cl.

CPC ..... *B65H 7/20* (2013.01); *B41J 11/42* (2013.01); *B65H 1/266* (2013.01); *B65H 9/20* (2013.01); *B65H 2301/30* (2013.01); *B65H 2511/242* (2013.01)

(58) Field of Classification Search

CPC ..... B65H 1/04; B65H 1/266

See application file for complete search history.

(56) References Cited

U.S. PATENT DOCUMENTS

| | | | | | |
|---|---|---|---|---|---|
| 4,971,311 | A * | 11/1990 | Tsukimoto | B65H 1/14 | 271/152 |
| 5,046,715 | A * | 9/1991 | Taniguchi | B65H 1/04 | 271/164 |
| 5,096,178 | A * | 3/1992 | Yamada | B65H 1/04 | 271/162 |
| 5,217,217 | A * | 6/1993 | Matsumoto | B65H 1/04 | 271/162 |
| 5,271,614 | A * | 12/1993 | Yamada | B65H 3/44 | 271/9.06 |
| 6,746,012 | B2 * | 6/2004 | Diews | B65H 9/10 | 271/164 |
| 8,096,550 | B2 * | 1/2012 | Shih | B41J 13/106 | 271/213 |

FOREIGN PATENT DOCUMENTS

| | | | |
|---|---|---|---|
| JP | 2018030665 A | * | 3/2018 |
| JP | 2019043723 A | * | 3/2019 |

* cited by examiner

*Primary Examiner* — Patrick Cicchino

(57) ABSTRACT

A method, non-transitory computer readable medium, and apparatus for automatically adjusting a feeder tray of a printing device are disclosed. For example, the method receives a signal to initiate a feeder tray adjustment routine, wherein the feeder tray adjustment routine determines an amount of lateral adjustment of the feeder tray to eliminate a lateral input error of a print media that is fed to a registration subsystem of the printing device, activates a mechanism to adjust a lateral position of the feeder tray by the amount that is determined, and feeds subsequent print media through the registration subsystem for printing an image on the subsequent print media.

16 Claims, 4 Drawing Sheets

ADJUSTMENT OF FEEDER TRAYS TO CORRECT ALIGNMENT ERROR OF PRINT MEDIA IN A REGISTRATION SUBSYSTEM

The present disclosure relates generally to printing devices and, more particularly, to a method and system to adjust feeder trays to correct alignment error of print media in a registration system.

BACKGROUND

Printing devices can be used to print images on print media. The print media can be fed through the printing device along a transport path and imaging path to have the image printed. Along the transport path and the imaging path, there are certain locations where processing errors can occur that can cause a misalignment of the image relative to the print media.

For example, the printing devices can have a registration subsystem. The registration subsystem may be responsible for correctly feeding the print media to an imaging system such that the printed image is correctly aligned with the print media. As the size and weight of print media grows larger and larger, it can be more and more difficult for currently designed registration subsystems to handle the larger print media. In addition, the market demands for increasing speed of print jobs may also exceed the capability of current registration subsystem designs.

SUMMARY

According to aspects illustrated herein, there are provided a method, a non-transitory computer readable medium, and an apparatus for automatically adjusting a feeder tray of a printing device. One disclosed feature of the embodiments is a method that receives a signal to initiate a feeder tray adjustment routine, wherein the feeder tray adjustment routine determines an amount of lateral adjustment of the feeder tray to eliminate a lateral input error of a print media that is fed to a registration subsystem of the printing device, activates a mechanism to adjust a lateral position of the feeder tray by the amount that is determined, and feeds subsequent print media through the registration subsystem for printing an image on the subsequent print media.

Another disclosed feature of the embodiments is a non-transitory computer-readable medium having stored thereon a plurality of instructions, the plurality of instructions including instructions which, when executed by a processor, cause the processor to perform operations that receive a signal to initiate a feeder tray adjustment routine, wherein the feeder tray adjustment routine determines an amount of lateral adjustment of the feeder tray to eliminate a lateral input error of a print media that is fed to a registration subsystem of the printing device, activate a mechanism to adjust a lateral position of the feeder tray by the amount that is determined, and feed subsequent print media through the registration subsystem for printing an image on the subsequent print media.

Another disclosed feature of the embodiments is an apparatus comprising a processor and a computer readable medium storing a plurality of instructions which, when executed by the processor, cause the processor to perform operations that receive a signal to initiate a feeder tray adjustment routine, wherein the feeder tray adjustment routine determines an amount of lateral adjustment of the feeder tray to eliminate a lateral input error of a print media that is fed to a registration subsystem of the printing device, activate a mechanism to adjust a lateral position of the feeder tray by the amount that is determined, and feed subsequent print media through the registration subsystem for printing an image on the subsequent print media.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to automatic adjustment of feeder trays to correct alignment errors of print media in a registration subsystem. As discussed above, printing devices can have a registration subsystem. The registration subsystem may be responsible for correctly feeding the print media to an imaging system such that the printed image is correctly aligned with the print media. As the size and weight of print media grows larger and larger, it can be more and more difficult for currently designed registration subsystems to handle the larger print media. In addition, the market demands for increasing speed of print jobs may also exceed the capability of current registration subsystem designs.

Previous methods attempt to re-design the registration subsystems to correct alignment errors. For example, the nips in the registration subsystems could be arranged differently or controlled differently to correct the lateral input error. But as noted above, as the size and weight of the print media grows larger, it can be difficult for even these re-designed registration subsystems to correct the lateral input error in a timely manner as the print media travels through the registration subsystem. In addition, operation of the nips (e.g., opening and closing certain nips) may introduce a delay and create inefficiencies during a print job.

Embodiments of the present disclosure provide a method to automatically adjust a feeder tray of the printing device to correct alignment errors, such as the lateral input error. In one embodiment, the feeder trays may each be coupled to a mechanism that can be controlled. The mechanism can be controlled to move in an inboard direction or an outboard direction to automatically adjust a lateral position of the feeder tray. Adjusting the lateral position of the feeder tray may help to ensure that the print media arrives at the registration subsystem in a proper alignment. In addition, providing automatic lateral adjustments to the feeder tray may provide a simpler and lower cost solution to correcting alignment errors than re-designing different components and controls within the registration subsystem.

Figure 1:
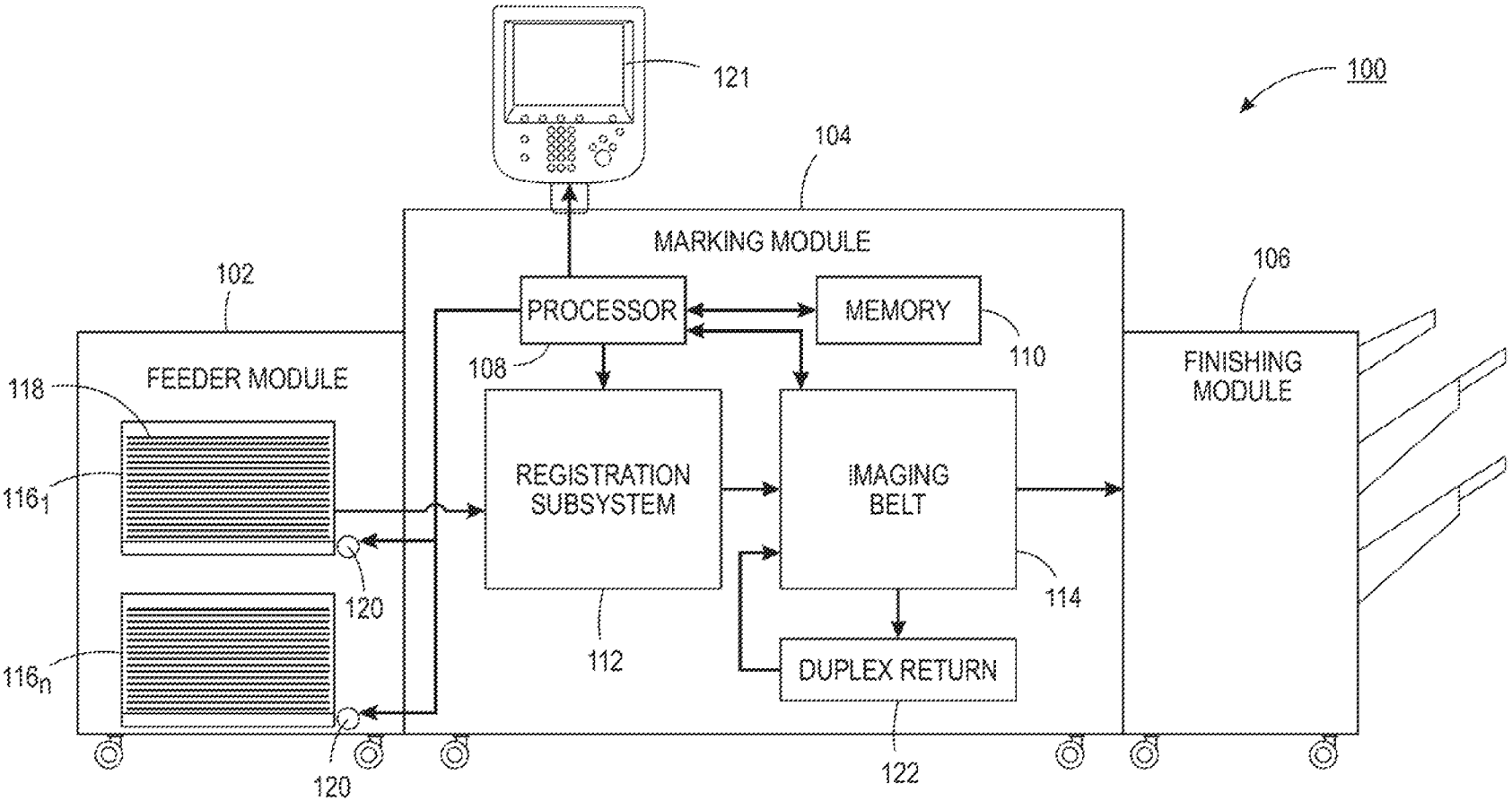
FIG. 1 illustrates a block diagram of example printing device of the present disclosure.

FIG. 1 illustrates a block diagram of an example printing device 100 of the present disclosure. The printing device 100 may be any type of printing device that uses a registration subsystem 112. For example, the printing device 100 may be a multi-function device (MFD), a laser printer, a copier, an inkjet printer, and the like.

In one embodiment, the printing device 100 may include a feeder module 102, a marking module 104, and a finishing module 106. It should be noted that the printing device 100 has been simplified for ease of explanation in FIG. 1. The printing device 100 may include additional components and modules that are not shown.

In one embodiment, the feeder module 102 may include a plurality of feeder trays $\mathbf{116}_1$ to $\mathbf{116}_n$ (also referred to herein individually as a feeder tray 116 or collectively as feeder trays 116). The feeder trays 116 may be cut-sheet feeder trays that feed sheets of print media 118 (as opposed to a continuous roll of print media). The feeder trays $\mathbf{116}_1$ to $\mathbf{116}_n$ may hold different types or sizes of print media 118. For example, the feeder tray $\mathbf{116}_1$ may hold 11 inch×28 inch sheets of print media 118 and the feeder tray $\mathbf{116}_n$ may hold 8.5 inch×14 inch sheets of print media 118. The dimensions are provided as examples and any size sheets of print media 118 may be fed through the printing device 100.

In one embodiment, each one of the feeder trays 116 may be coupled to a mechanism 120 that may move the respective feeder tray 116 along a lateral direction. For example, the lateral direction may be an inboard direction or an outboard direction (e.g., into or out of the page when looking at FIG. 1, or away from a user or towards a user, respectively). The mechanism 120 may be any type of mechanical or electro-mechanical device or system that can be used to move the feeder tray 116. Examples of the mechanism 120 are discussed in further detail below.

In one embodiment, the marking module 104 may include the registration subsystem 112, an imaging belt 114, and a duplex return 122. The marking module 104 may also include a processor 108 and a memory 110 (e.g., a non-transitory computer readable memory). Although the processor 108 and the memory 110 are illustrated as being in the marking module 104, it should be noted that the processor 108 and the memory 110 may be located anywhere in the printing device 100.

The processor 108 may be communicatively coupled to the registration subsystem 112, the imaging belt 114, and the mechanisms 120. The registration subsystem 112 may be used to align the print media 118 before being fed to the imaging belt 114. The imaging belt 114 may then print a desired image onto the print media 118 and cure the image before feeding the print media 118 to the finishing module 106. For example, in a laser printer, toner may be layered, or dispensed, onto the imaging belt 114 via one or more printheads. The imaging belt 114 may move or rotate towards the print media 118 as the toner is being dispensed. The imaging belt 114 with the toner may then contact the print media 118 to transfer the toner onto the print media 118 in a pattern of the desired image. The print media 118 with the toner may then be cured or dried.

In one embodiment, the duplex return 122 may be optional. The duplex return 122 may allow an image to be printed on both sides of the print media 118. The duplex return 122 may include a translating nip (not shown) that can also be coupled to a mechanism 120 to be moved laterally.

In one embodiment, the processor 108 may execute instructions associated with a feeder tray adjustment routine stored in the memory 110. In one embodiment, a user may transmit a signal to start the feeder tray adjustment routine via a graphical user interface (GUI) 121 of the printing device 100.

In another embodiment, the feeder tray adjustment routine may be automatically initiated based on an amount of lateral input error exceeding a threshold. For example, the processor 108 may monitor an amount of lateral input error for each print media 118 that is fed through the registration subsystem 112. An average of the amount of lateral input error may be calculated for a rolling count of a predetermined number of sheets of the print media 118 (e.g., every 20 sheets). If the average is above a predefined threshold (e.g., 0.5 millimeters (mm) in either the inboard or outboard direction), the processor 108 may pause a current print job and execute the feeder tray adjustment routine.

Figure 2:
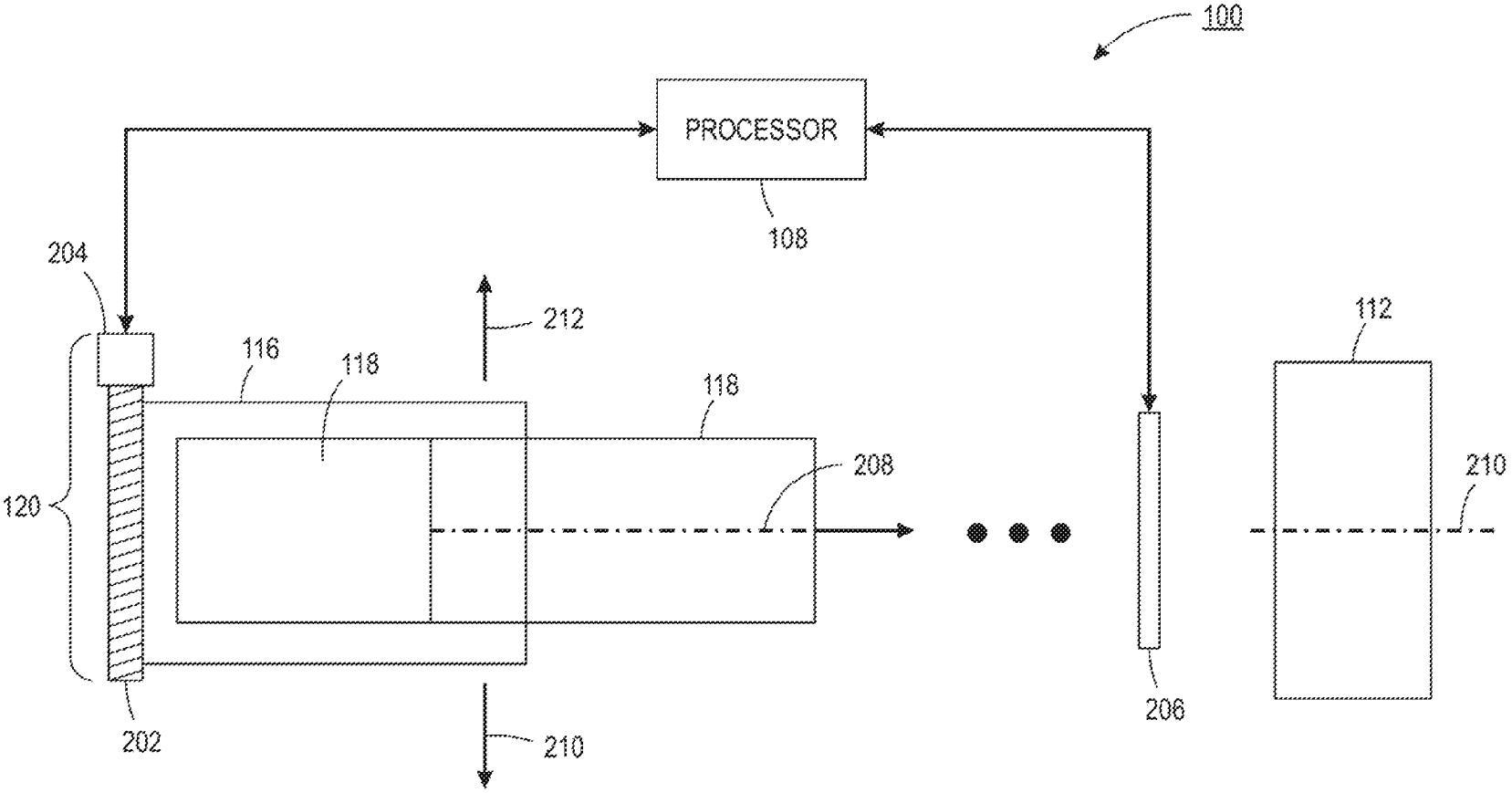
FIG. 2 illustrates a top view of an example printing device of the present disclosure.

FIG. 2 illustrates a top view of the printing device 100 that helps to explain the lateral input error. In one embodiment, the print media 118 may be aligned such that a centerline 208 of the print media 118 is aligned with a centerline 210 of the registration subsystem 112. Any deviation from this alignment may be referred to as the lateral input error. When the centerline 208 of the print media 118 and the centerline 210 of the registration subsystem 112 are aligned, the image that is printed by the imaging belt 114 may be centered or aligned correctly on the print media 118. In other words, there is no lateral input error.

In one embodiment, the registration subsystem 112 may include one or more sensors 206. The sensors 206 may be any type of sensor, such as a charged coupled device (CCD) sensor. The sensors 206 may measure the lateral input error. For example, as the print media 118 travels over the sensor 206, the sensor 206 may detect an amount of lateral input error of the print media 118 relative to the centerline 210 of the registration subsystem 112. The sensor 206 may also detect or measure other errors such as skew of the print media 118.

The measurements of lateral input error from the sensor 206 in the registration subsystem 112 may be transmitted back to the processor 108. The processor 108 may calculate an amount of lateral adjustment of the feeder trays 116 via the mechanism 120 based on the measurements of lateral input error. As discussed above, the amount of lateral adjustment may be based on an average lateral input error of a predetermined number of sheets of the print media 118.

FIG. 2 illustrates one example of the mechanism 120. In one embodiment, the mechanism 120 may include a lead screw 202 coupled to a motor 204. The processor 108 may control operation of the motor 204 to rotate the lead screw 202. Rotation of the lead screw 202 may cause the respective feeder tray 116 to move along an inboard direction (e.g., a direction as shown by an arrow 212) or an outboard direction (e.g., a direction as shown by an arrow 210).

However, it should be noted that other designs for the mechanism 120 may be deployed. For example, the mechanism 120 may be a movable carriage coupled to the feeder tray 116, a system of activated magnets coupled to the feeder tray 116, a rotating belt coupled to the feeder tray 116, and the like.

The processor 108 may control the mechanism 120 (e.g., the motor 204) to move the feeder tray 116 by the amount of lateral adjustment that is calculated. By automatically adjusting the lateral position of the feeder tray, the lateral input error at the registration subsystem 112 may be eliminated. As noted above, the processor 108 may also automatically adjust a lateral position of a translating nip in the duplex return 122 via respective mechanism 120 coupled to the translating nip.

As noted above, the feeder tray adjustment routine may be executed by the processor 108 to calculate the amount of lateral adjustment for the feeder trays 116. In one embodiment, the feeder tray adjustment routine may feed a predetermined number of sheets (e.g., 10 sheets, 20 sheets, 50 sheets, and the like) of the print media 118 through the registration subsystem 112 without imaging. In other words, the sheets of the print media 118 are fed through the registration subsystem 112 and to the finishing module 106 without printing an image onto the print media 118.

The sensor 206 may measure the lateral input error for each sheet of the print media 118 that is fed through the registration subsystem 112. The measurements may be received by the processor 108. The processor 108 may calculate an average of the lateral input errors of all of the predetermined number of sheets of the print media 118. The average value may be the amount of lateral adjustment that is applied to the feeder trays 116. The average value may also include a direction (e.g., 1 millimeter (mm) inboard, or 0.5 mm outboard, and the like).

In one embodiment, the amount of lateral adjustment for a particular feeder tray 116 and a particular size of print media 118 may be stored in the memory 110. Each feeder tray 116 may have a different amount of lateral adjustment for different sizes of print media 118. As a result, when the feeder tray adjustment routine is initiated, the routine may initially check the memory 110 to determine if the amount of lateral adjustment has been previously calculated for the feeder tray 116 that is selected and the size of the print media 118 that is selected. If the amount of lateral adjustment was previously calculated and stored in the memory 110, then the feeder tray adjustment routine may initially apply the stored amount of lateral adjustment.

In one embodiment, after the lateral position of the feeder tray 116 is adjusted, the processor 108 may continue to monitor the lateral input error during a print job. For example, the sensor 206 may continue to measure the lateral input error for each subsequent sheet of the print media 118 that is fed through the registration subsystem 112.

In one embodiment, if the lateral input error for any subsequent sheet of print media 118 exceeds a threshold (e.g., 1 mm), then the processor 108 may pause the current print job and re-execute the feeder tray adjustment routine. In another embodiment, the processor 108 may keep a rolling average of the lateral input error of a number of subsequent sheets of the print media 118 (e.g., the last 10 sheets). If the average exceeds the threshold, then the processor 108 may pause the current print job and re-execute the feeder tray adjustment routine.

In one embodiment, the processor 108 may activate the mechanism 120 to move the feeder tray laterally by an updated amount. The updated amount may be an amount of lateral movement that is calculated by the lateral input error of the subsequent sheets of print media 118 that are fed through the registration subsystem 112 for the print job. In other words, the lateral input error that the processor 108 is periodically tracking during a print job may be used to calculate the amount of lateral movement rather than re-executing the feeder tray adjustment routine.

Figure 3:
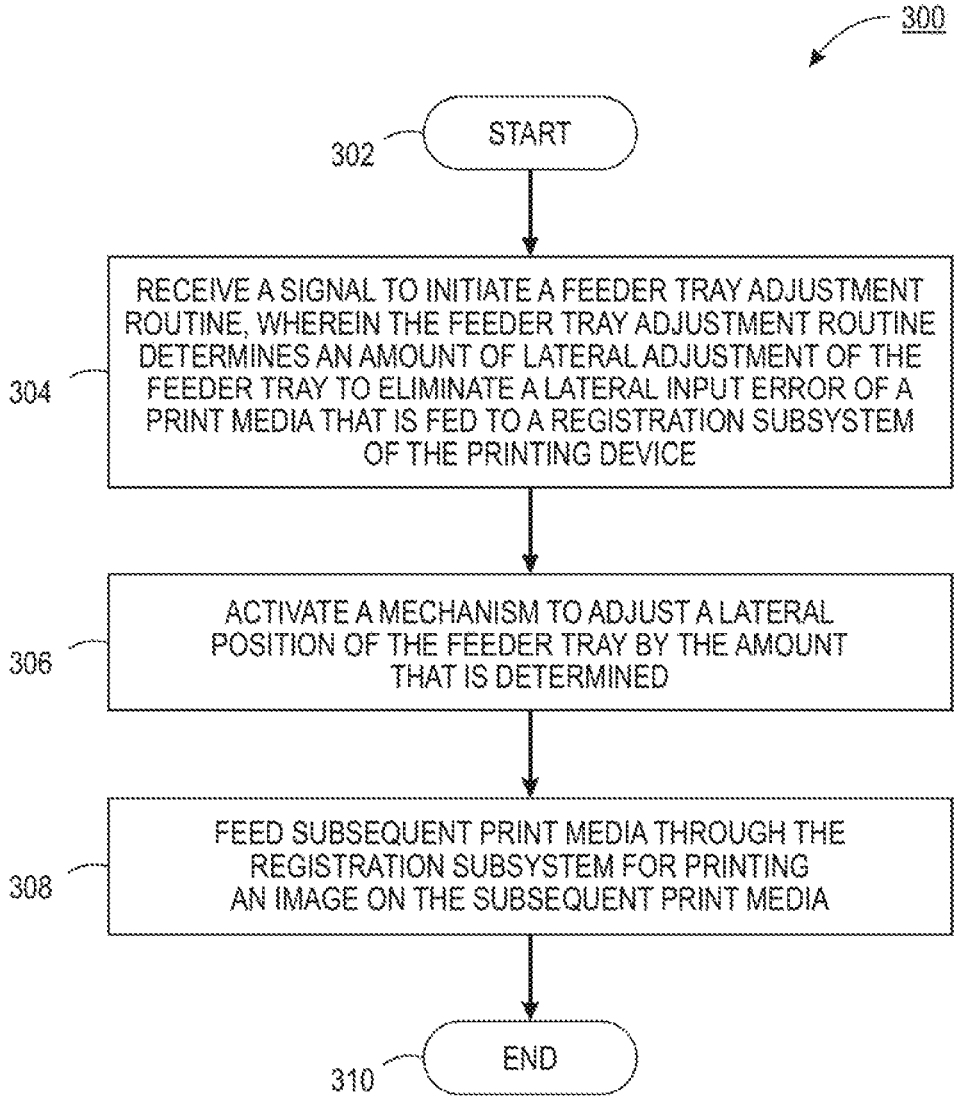
FIG. 3 illustrates a flowchart of an example method for automatically adjusting a feeder tray of a printing device of the present disclosure.
Figure 4:
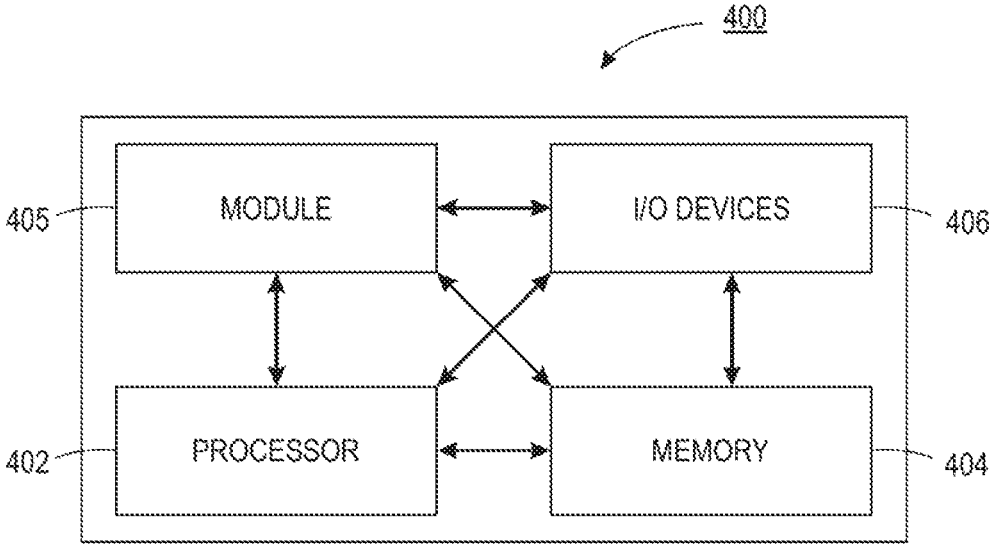
FIG. 4 illustrates a high-level block diagram of an example computer suitable for use in performing the functions described herein.

FIG. 3 illustrates a flowchart of an example method 300 for automatically adjusting a feeder tray of a printing device. In one embodiment, one or more steps or operations of the method 300 may be performed by the printing device 100, or a computer/processor that controls operation of the printing device 100 as illustrated in FIG. 4 and discussed below.

At block 302, the method 300 begins. At block 304, the method 300 receives a signal to initiate a feeder tray adjustment routine, wherein the feeder tray adjustment routine determines an amount of lateral adjustment of the feeder tray to eliminate a lateral input error of a print media that is fed to a registration subsystem of the printing device. In one embodiment, the signal may be submitted by a user via a GUI of the printing device.

In another embodiment, the signal may be generated by a processor of the printing device based on an amount of the lateral input error exceeding a threshold, wherein the amount of the lateral input error is based on measurements received from one or more sensors that measure the lateral input error in the registration subsystem. In other words, the signal may be received during monitoring of the lateral input error during an ongoing print job.

In one embodiment, the feeder tray adjustment routine may include feeding a predetermined number of sheets of print media into the registration subsystem. The sheets of print media may be fed through the registration subsystem, and other subsystems of the printing device, without processing or printing any images on the sheets of print media. The predetermined number of sheets of print media may be fed only to measure the lateral input error of each sheet.

The amount of lateral input error may be received by a processor of the printing device from one or more sensors that measure the lateral input error in the registration subsystem. The one or more sensors may measure the lateral input error for each one of the predetermined number of sheets of print media that is fed through the registration subsystem. The processor of the printing device may then calculate the amount of lateral adjustment based on an average of the amount of lateral input error for each one of the predetermined number of sheets of print media.

In one embodiment, the amount of lateral adjustment that is calculated may be stored in memory. For example, the amount of lateral adjustment for a particular feeder tray and a particular size of print media may be stored in memory and recalled in a subsequent print job. For example, when the signal to execute the feeder tray adjustment routine is received, the processor may check the memory to determine if the amount of lateral adjustment was previously calculated and saved for a particular feeder tray and a particular size of print media. If the amount of lateral adjustment was previously calculated, the processor may initially implement the amount of lateral adjustment without having to feed a predetermined number of sheets of print media to measure the lateral input error and re-calculate the amount of lateral adjustment for the feeder tray.

In one embodiment, the predetermined number of sheets of print media may also be fed through a duplex return path. The lateral input error of each sheet of print media in the duplex return path may be measured by a duplex sensor that measures an amount of lateral input error in the duplex return path. The lateral input error in the duplex return path may be used to calculate an amount of lateral adjustment for a translating nip in the duplex return path. For example, an average of the lateral input error for each sheet in the duplex return path may be calculated and used as the amount of lateral adjustment for the translating nip.

At block 306, the method 300 activates a mechanism to adjust a lateral position of the feeder tray by the amount that is determined. For example, a motor or other type of mechanical device, can be activated to move the feeder tray by the amount of lateral adjustment that is calculated. In one embodiment, the processor may also activate a mechanism to move a translating nip in the duplex return path.

At block 308, the method 300 feeds subsequent print media through the registration subsystem for printing an image on the subsequent print media. In one embodiment, as the subsequent print media is being fed to execute a print job, the method 300 may continue monitoring the lateral input error.

For example, the processor of the printing device may periodically receive a measurement of the lateral input error for the subsequent print media from the one or more sensors in the registration subsystem that measure the lateral input error. The processor may then compare the lateral input error to a predetermined threshold. For example, the processor may calculate a rolling average of the lateral input error of the last five, ten, twenty, and the like, subsequent sheets that are fed through the registration subsystem and compare the average to the predetermined threshold. If the average is above the predetermined threshold, the processor may pause the current print job. In other words, the processor may pause feeding the subsequent print media through the registration subsystem for printing the image.

In one embodiment, the method 300 may then re-execute the feeder tray adjustment routine. In another embodiment, the method 300 may activate the mechanism to move the feeder tray laterally by an updated amount (e.g., the rolling average of lateral input error of the subsequent sheets of print media). At block 310, the method 300 ends.

It should be noted that the blocks in FIG. 3 that recite a determining operation or involve a decision do not necessarily require that both branches of the determining operation be practiced. In other words, one of the branches of the determining operation can be deemed as an optional step. In addition, one or more steps, blocks, functions or operations of the above described method 300 may comprise optional steps, or can be combined, separated, and/or performed in a different order from that described above, without departing from the example embodiments of the present disclosure.

FIG. 4 depicts a high-level block diagram of a computer that is dedicated to perform the functions described herein. As depicted in FIG. 4, the computer 400 comprises one or more hardware processor elements 402 (e.g., a central processing unit (CPU), a microprocessor, or a multi-core processor), a memory 404, e.g., random access memory (RAM) and/or read only memory (ROM), a module 405 for method for automatically adjusting a feeder tray of a printing device, and various input/output devices 406 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the printing device 100). For example, computer readable instructions pertaining to the method(s) discussed above can be used to configure a hardware processor to perform the steps, functions and/or operations of the above disclosed methods. In one embodiment, instructions and data for the present module or process 405 for method for automatically adjusting a feeder tray of a printing device (e.g., a software program comprising computer-executable instructions) can be loaded into memory 404 and executed by hardware processor element 402 to implement the steps, functions or operations as discussed above in connection with the example method 300. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 405 for method for automatically adjusting a feeder tray of a printing device (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for automatically adjusting a feeder tray of a printing device, comprising:

receiving, by a processor, a signal to initiate a feeder tray adjustment routine, wherein the feeder tray adjustment routine, comprises:

feeding a predetermined number sheets of print media into a registration subsystem;

receiving, by the processor, an amount of lateral input error from one or more sensors that measure the lateral input error in the registration subsystem for each one of the predetermined number of sheets of print media that is fed into the registration subsystem; and calculating, by the processor, an amount of lateral adjustment based on an average of the amount of lateral input error for the each one of the predetermined number of sheets of print media;

activating, by the processor, a mechanism to adjust a lateral position of the feeder tray by the amount that is determined; and feeding subsequent print media through the registration subsystem for printing an image on the subsequent print media.

2. The method of claim 1, wherein the signal is generated by the processor based on the amount of the lateral input error exceeding a threshold, wherein the amount of the lateral input error is based on measurements received from one or more sensors that measure the lateral input error in the registration subsystem.

3. The method of claim 1, wherein the feeder tray adjustment routine, further comprises:

receiving, by the processor, an amount of lateral input error from a duplex sensor that measures an amount of lateral input error in a duplex return path for the each one of the predetermined number of sheets of print media that is fed through the duplex return path; and calculating, by the processor, an amount of lateral adjustment for a translating nip in the duplex return path.

4. The method of claim 3, wherein the amount of lateral adjustment is saved in a memory for the feeder tray for a type of a print media.

5. The method of claim 1, wherein the feeder tray adjustment routine comprises:

checking, by the processor, a memory to obtain the amount of lateral adjustment for the feeder tray and for a type of the print media that was previously stored in the memory.

6. The method of claim 1, further comprising:

periodically receiving, by the processor, a measurement of the lateral input error for the subsequent print media from one or more sensors in the registration subsystem that measure the lateral input error;

determining, by the processor, that the amount of lateral input error exceeds a predetermined threshold; and pausing, by the processor, the feeding of the subsequent print media through the registration subsystem for printing the image.

7. The method of claim 5, further comprising:

re-executing, by the processor, the feeder tray adjustment routine.

8. The method of claim 5, further comprising:

activating, by the processor, the mechanism to move the feeder tray laterally by an updated amount that is based on the amount of lateral input error of the subsequent print media that is fed to the registration subsystem.

9. A non-transitory computer-readable medium storing a plurality of instructions which, when executed by a processor, cause the processor to perform operations for automatically adjusting a feeder tray of a printing device, the operations comprising:

receiving a signal to initiate a feeder tray adjustment routine, wherein the feeder tray adjustment routine, comprises:

feeding a predetermined number sheets of print media into a registration subsystem;

receiving, by the processor, an amount of lateral input error from one or more sensors that measure the lateral input error in the registration subsystem for each one of the predetermined number of sheets of print media that is fed into the registration subsystem; and calculating, by the processor, an amount of lateral adjustment based on an average of the amount of lateral input error for the each one of the predetermined number of sheets of print media;

activating a mechanism to adjust a lateral position of the feeder tray by the amount that is determined; and feeding subsequent print media through the registration subsystem for printing an image on the subsequent print media.

10. The non-transitory computer-readable medium of claim 9, wherein the signal is generated by the processor based on the amount of the lateral input error exceeding a threshold, wherein the amount of the lateral input error is based on measurements received from one or more sensors that measure the lateral input error in the registration subsystem.

11. The non-transitory computer-readable medium of claim 9, wherein the feeder tray adjustment routine, further comprises:

receiving an amount of lateral input error from a duplex sensor that measures an amount of lateral input error in a duplex return path for the each one of the predetermined number of sheets of print media that is fed through the duplex return path; and calculating an amount of lateral adjustment for a translating nip in the duplex return path.

12. The non-transitory computer-readable medium of claim 11, wherein the amount of lateral adjustment is saved in a memory for the feeder tray for a type of a print media.

13. The non-transitory computer-readable medium of claim 9, wherein the feeder tray adjustment routine comprises:

checking a memory to obtain the amount of lateral adjustment for the feeder tray and for a type of the print media that was previously stored in the memory.

14. The non-transitory computer-readable medium of claim 9, further comprising:

periodically receiving a measurement of the lateral input error for the subsequent print media from one or more sensors in the registration subsystem that measure the lateral input error;

determining that the amount of lateral input error exceeds a predetermined threshold; and pausing the feeding of the subsequent print media through the registration subsystem for printing the image.

15. The non-transitory computer-readable medium of claim 14, further comprising:

re-executing the feeder tray adjustment routine.

16. A method for automatically adjusting a feeder tray of a printing device, comprising:

receiving, by a processor, a user input signal from a graphical user interface of the printing device to initiate a feeder tray adjustment routine, wherein the feeder tray adjustment routine, comprises:

feeding a predetermined number sheets of print media into a registration subsystem;

receiving, by the processor, an amount of lateral input error from one or more sensors that measure the lateral input error in the registration subsystem for each one of the predetermined number of sheets of print media that is fed into the registration subsystem; and calculating, by the processor, an amount of lateral adjustment based on an average of the amount of lateral input error for the each one of the predetermined number of sheets of print media;

activating, by the processor, a motor coupled to a lead screw that is coupled to the feeder tray to adjust a lateral position of the feeder tray by the amount of lateral adjustment that is calculated;

feeding subsequent print media through the registration subsystem for printing an image on the subsequent print media;

monitoring, by the processor, the lateral input error of the subsequent print media periodically via the one or more sensors in the registration subsystem; and re-executing, by the processor, the feeder tray adjustment routine, when the lateral input error of the subsequent print media exceeds a threshold.

* * * * *